United States Patent [19]

Asszonyi et al.

[11] Patent Number: 4,505,622

[45] Date of Patent: Mar. 19, 1985

[54] PROCESS AND ARRANGEMENT FOR THE SUPPORT OF UNDERGROUND CAVITY SYSTEMS BY AN EFFICIENT SAFETY CASING WALL

[75] Inventors: Csaba Asszonyi, Budapest; István Klausz, Sárisáp; István Kmety, Dprog; Nándor Meitzen; Rezso Pásztor, both of Budapest, all of Hungary

[73] Assignee: Magyar Szénbányászati Tröszt, Tatabanya, Hungary

[21] Appl. No.: 155,789

[22] Filed: Jun. 2, 1980

Related U.S. Application Data

[63] Continuation of Ser. No. 906,778, May 17, 1978.

[30] Foreign Application Priority Data

May 17, 1977 [HU] Hungary ..... MA 2875

[51] Int. Cl.[3] ..... E21D 11/00

[52] U.S. Cl. ..... 405/288; 405/146; 405/150

[58] Field of Search ..... 405/288, 150, 303, 291-302, 405/146, 290, 151-153

[56] References Cited

U.S. PATENT DOCUMENTS

| | | | |
|---|---|---|---|
| 2,148,783 | 2/1939 | Spaulding | 405/150 |
| 3,304,954 | 2/1967 | Kaiser | 405/150 X |
| 3,381,479 | 5/1968 | Curzio | 405/150 |
| 4,010,616 | 3/1977 | Lovat | 405/132 |

FOREIGN PATENT DOCUMENTS

| | | | |
|---|---|---|---|
| 821190 | 8/1969 | Canada | 405/146 |
| 1018013 | 10/1957 | Fed. Rep. of Germany | 405/288 |

*Primary Examiner*—Dennis L. Taylor

*Attorney, Agent, or Firm*—Gabriel P. Katona

[57] ABSTRACT

This invention relates to a method for bracing an underground cavity, wherein the cavity is lined with a tensionable layer, an expansible arch is then inserted against said layer, the arch is then tensioned and clamped in position to exert pressure in accordance with a specified formula.

13 Claims, 16 Drawing Figures

PROCESS AND ARRANGEMENT FOR THE SUPPORT OF UNDERGROUND CAVITY SYSTEMS BY AN EFFICIENT SAFETY CASING WALL

This is a continuation of Ser. No. 906,778 filed on May 17, 1978.

The invention concerns a process and an arrangement for the complex support of underground cavities or cavity systems such as mine road or drift, tunnel, industrial halls, liquid reservoirs, etc.

The disadvantages of the generally known processes and arrangements for the same purpose are as follows:

As a consequence of the manner of installing the temporary and permanent support devices (props, shafts, rings, etc.) a full adaptation of the support to the rock is obtained at a point in time determined by the rheological properties of the surroundings, generally after a significant rock deformation.

As a consequence—even before the support is loaded—rock deterioration starts which results in a considerable narrowing of the sections and increases maintenance costs. This causes the support to have a short life, and the load of the support which changes with time is distributed in a random manner—and cannot be planned in advance—, consequently at certain locations of the support stress peaks may form which result in damage or destruction zones not only in the rock but also in the support.

The hitherto known support installing technology could not be taken into account in a precalculable manner so that the support structure substantially influences the surrounding rock; this reaction may cause an unavoidable process of heavy destructions, and cannot provide for a favorable balance between the rock and the support.

Attempts are known to classify rock into different classes on the basis of an idealization of their actual characteristics and behavior. The strength characteristics of the support are to be associated with these idealized characteristics. (See Rabcewict-Sattler: The new Austrian Tunnel Building Method. Bauingenieur 1965, No. 8).

Naturally this idealization did not allow the most recent researches into the mechanics of rock to be carried into practice and has hindered the spread of the recent technology.

It is no coincidence that the mentioned method has only been maintained in the field of tunnel construction. Serious damages, and even destructions, can be prevented by the closed-loop regulating system according to this invention, wherein the support cooperates with the surrounding rock to adjust a load-distribution level between the rock and the support; both the rock and the support; both the rock and the support are expected to endure deformations which exceed the permitted magnitudes. Conventional solutions do not provide a facility to modify the value of the rock pressure within wide limits. In these cases the pressure of the surrounding rock constitutes an in situ natural characteristic, and thus load levels arise which virtually necessitate destruction of the support. Thus new supports have to be built in from time to time.

The conventional solutions only provide specific data—relating solely to the support—and do not provide development of a modular process and apparatus—noting that cavity formation and their support constitute a complex system—which can be adapted to varied cavity forming methods, geometric configurations of the caivty, and to varying transport systems, forming an integral unit with such systems.

The gist of the invention consists in that the changes that take place in the course of forming a cavity are defined according to the results of the latest rheological researches as they relate to the rock and the support structure, the parameters being determined according to a complex system involving all the characteristics of the surrounding and their change with time. The processes and arrangements are then realized by the aid of these parameters.

The technological steps determined by the invention are thus time-dependent functions, the relative use of which is interpreted on the basis of the rheological changes of the rock and the support. From this it follows that the essential feature of the invention is the scientific discovery that in the support of underground cavities, the emphasis is not on a defense against nature (by taking up the pressure of the rock with a support apparatus) but rather through a good knowledge of the laws of nature by utilizing these laws such that a deliberate regulative activity is achieved rather than a mere defense.

Thus the invention concerns a system of practical deductions inferrable from the new theories concerning the mechanics of rocks wherein the planning, dimensioning and technological formation of the support and supporting devices as well as the installations therefor are all incorporated.

The support of cavities made by the various technical and technological processes is a complex task. In the course of solving this task one must have regard to a complexely interrelated system of conditions of which the principal element groups are the following:

stress conditions in the neighborhood of the cavity
physical and mechanical parameters of the rock
manner, means and technology of forming the cavity
geometry (shape and dimensions) of the cavity
characteristics of the used support.

The exemplary elements of the following description may naturally be substituted by structural elements of similar function but the essence of the invention consists in their coordination into a unitary system.

In accordance with the foregoing it is our opinion that the rock formation and the supporting structure form a collaborating double system wherein a suitably constructed support apparatus and the excess pressure caused by the bracing of the cavity, the so-called transferred pressure, are divided between the rock and the support in such a way that both accommodate the excess pressure without damage or destruction.

This recognition has led to a re-evaluation of the task of supporting structures and to the development of new support technologies suited to these new circumstances.

The requirements of the support are the following:

a/ Activity. By this is meant the property of the support which immediately on installation takes part in road balancing, prevents the excess pressure to be transferred to the rock, which would initiate processes whereby rock falls could occur and the controllability of the mechanical phenomena could be lost.

b/ Yieldability. By this property the automatic control of the dual (rock-support) system can be realized. The support apparatus installed in the caivty is made to be in contact with the rock and takes part therewith in the bearing of the excess pressures or stresses. The transfer of load from the rock to the support takes place with certain attendant deformations. Since all rock-mechanical process is a rheological process this transfer of stress takes place continuously with time at a rate dependent upon the support constants and the characteristics of the rock. The yieldability of the support is destined to fulfill a regulating function of undergoing a permissible small deformation whenever the load is transmitted to the support or reaches an undesirable value whereby to avoid a destructive load on the support. This process continues until an equilibrium is reached wherein both the support and the rock carry a load supportable without damaging consequences.

c/ Load-bearing capacity represents the sum of the strength characteristics of the supporting structure. Without suitable load-bearing capacity, an equilibrium state could only be reached after complete filling up of the cavity, tantamount to the destruction of the cavity and its surroundings.

The requirements of the support are fully met by a so-called steel supporting apparatus employing tensioning and/or a shaft support with shot or sprayed concrete (possessing adequate elasticity and rigidity characteristics).

In the case of using a steel support the essence of the process is the tensioning of the arcs or arches installed in the excavated cross-sectional areas by means of a predetermined pressure with the aid of hydraulic forepoling and tensioning apparatus. By tensioning the support—with a pressure $P_o$—the value of the transferred pressure is decreased to $(P_{pr}-P_o).L$ compared with the original value $P_{pr}.L$, wherein $P_{pr}$ represents the primary pressure normal to the plane of the cavity under examination, and L is the relevant dimension of the cavity. The following correlations are set out for explanation:

how the support should be pre-tensioned in the case of a section of long life, how the support should be pre-tensioned in the case of cavities of a planned lifetime, how the support should be pre-tensioned according to the mechanical condition of the surrounding rock in the case of the most favorable cavity configuration, how the installation length of the support should be determined.

The pre-tensioning of the support in the case of long life (exceeding 15 to 20 years) takes place with a pressure $P_o$:

$$P_o = \xi P_{pr} - \frac{\sigma_{meg}^{bizt}}{2\,\alpha\,An} \qquad 1$$

wherein $\xi$ is a factor dependent on the purpose of the cavity $P_{pr}$ is a primary stress prevailing at the location of bracing the cavity $\sigma_{meg}^{bizt}$ is the standard load permitted for the support n is a safety factor $\alpha$ is the cooperation coefficient of the rock and the support, expressed by the multi-variant function:

$\alpha = f(E_b, m_b, L, K_b, G)$, wherein $E_b$ is the elastic modulus of the support $m_b$ is the Poission number of the support L is the main dimension (span length) of the support $K_b$ is the standard cross-sectional factor of the support G is the elastic modulus of the rock jacket Pre-stressing of the support in the case of a planned life $t_o$:

$$P_o = \xi P_{pr} - \frac{\sigma_{meg}^{bizt}}{2\,\alpha\,An\,(1 - e^{\beta t})} \qquad 2$$

wherein e is 2.71 (the base number of natural logarithm)

$t_o$ is the planned life of the cavity $\beta$ is the time factor of the cooperating rock and support, which can be calculated on the basis of rheological constants of the support and the rock, as well as the dimension of the construction:

$$\beta = f(E_b, m_b, L, K_b, G, \tau, \eta)$$

in which expression $\tau$ is the relaxation factor of the rock $\eta$ is the viscosity factor of the rock, creep modulus $\xi$ is a factor dependent on the purpose of the cavity $P_{pr}$ is a primary stress prevailing at the location of bracing the cavity $\sigma_{meg}^{bizt}$ is the standard load permitted for the support n is a safety factor A is a mechanical constant which is computed from and depends on the shape and dimensions of the support $\alpha$ is the cooperation coefficient of the rock and the support (The further symbols have the same significance as above).

In the case where the most favorable shape of the cavity (from the point of view of the load distribution of the rock and the support)—regarding the mechanical condition of the rock—cannot be formed then the prestressing of the support to be installed in a section of given geometry must be determined such that it approximates an optimum stress condition.

The pressure transmitted through a pressing jaw in the direction of the primary principal stress makes an angle $\psi$ with the clockwise direction:

$$P_\psi = \frac{P_o}{2(k-1)}\,[k + (k-2)\cos 2\psi] \qquad 3$$

wherein $P_o$ is the pressure value k is the quasi-Poisson number valid for the location of the cavity bracing

INSTALLATION LENGTH OF THE SUPPORT

Let 1 be the installation length of a support in the case of a support apparatus without prestressing. If the latter is of the value $P_o$ then the installation length can be increased by a factor of $\psi$, i.e.

$$1_o = 1.\psi$$

in which equation $$\psi = \sqrt{\frac{\xi \cdot P_{pr}}{\xi \cdot P_{pr} - P_o}} \qquad 4$$

$\xi$ is a factor dependent on the purpose of the cavity $P_{pr}$ is the primary main stress $P_o$ is the pre-stressing which values can be computed from equations 1 and/or 2.

For certain parts or measures of the invention earlier attempts are known, such as for instance the German Pat. No. 1,143,468, relating to the pre-stressing of the support.

However, the known processes are not efficient because they did not take into account those mechanical processes taking place with time wherein the rock environment and the support display a behavior or functions that are determined in advance. This means, e.g., that in a primary field characterizable with a quasi-Poission number of k=2 or a figure close thereto, the true-to-side lateral support clamping in the case of a driven road can cause such serious damages which only cease when the cavity is closed.

The present invention bases itself on the modern theory of the mechanics of rocks and, on the basis of provably successful experiments—in the knowledge of the parameters of the rock, and of the primary stress field—provides the possibility of using an optimum technology, taking measurements with the aid of a computer, for maintaining control of the mechanical processes which change with time.

CONTINUOUS SHAFT SUPPORT (SHELL SUPPORT) OF AN ADEQUATE ELASTIC MODULUS

The use of traditional shaft supports has the defect that there is lack of cooperation between the rock and the shaft vault. In the case of a usual shaft thickness ($v/d \geqq \frac{1}{8}$) the shafts are very stiff.

These defects can be eliminated—at least reduced—by filling up the gap between the rock mantle and the shaft support, or by the utilization of yielding inserts.

When this gap is filled manually with mortar this expedient is useless. Although in given cases the injection of said or mortar can provide a better filling this expedient is still not satisfactory.

The fundamental defect of filling the space behind the shaft is that this can only be effected after the event and the effect of cooperation arises only belatedly, in other words only after destruction of the rock takes place—during the period of the separately encountered stress. One can accordingly appreciate the importance of density at the support points (slide-bar heads) of the cavity mantle.

The above-described defects are completely eliminated by the inventive process by using a shot or sprayed concrete technology, adapted to the latest rock-mechanical principles and determined in advance.

The thickness of the shot or sprayed concrete layer is a definite part of the cavity but is of a smaller magnitude and therefore has to be regarded as a sheel construction. The small layer thickness and a perfect fit to the rock result in such a support being of predetermined deformability (elasticity) which perfectly cooperates with the rock from the commencement of the installation.

The new principles, related to the rock mechanics, determine the behavior of the cavity environment, and on that basis one can determine the change in time of the load increase on the shot concrete shell; thus the hardening of the shot concrete can be controlled in a programmed manner—with the deliberate proportioning of the concrete mixture.

The dimensional correlations described below ensure the optimum coordination of the two processes and the formation of the most favorable construction as well as the maintenance at a predetermined load-bearing value between the rock and the support.

The function of the cavity support construction realized by means of the shot concrete technology can be characterized in that the shell construction matches the rock perfectly, it has corresponding statical properties, and satisfies all demands made on the supporting apparatus (activity, yieldability, load-bearing capacity). A further advantage of this procedure is that it can be fitted into any cavity bracing technology and is readily mechanizable.

The wall thickness of the shot concrete shaft in the case of a longer life (greater than 20 years) can be determined by two methods:

a/ The load on the rock should not cause a destructive process at the circumference of the cavity, i.e. the reduced standard stress rising in the rock mantle should at no time exceed the permitted value:

$$\sigma^{rock}_{reduced} \leqq \sigma^{rock}_{permitted}$$

The value $V_1$ can be determined from the following relation, where $\alpha = \alpha\ (\ldots V_1 \ldots)$:

$$2\,(\xi\, P_{pr} - P_o)\, AL_o\,(1 - \alpha) = \frac{\sigma^{rock}_{permitted}}{n_1}$$

The standard load of the support should remain below a permitted value:

$$\sigma^{support}_{reduced} \leqq \sigma^{support}_{permitted}$$

The thickness $V_2$ of the support can be calculated from the correlation:

$$2\,(\xi\, P_{pr} - P_o)\, AL_o\, \phi\,(R,\ V_2)\, \alpha = \frac{\sigma^{support}_{permitted}}{n_2}$$

The wall thickness of the support should be taken equal to the greater of $V_1$ and $V_2$, i.e.:

$$V = Max\{V_1;\ V_2\}$$

Symbols:

$\xi$ is a factor dependent on the purpose of the cavity $P_{pr}$ is a primary stress prevailing at the location of bracing the cavity $P_o$ is the prestressing pressure of the support A is a constant which is computed from and dependent on the shape and dimensions of the cavity section $L_o$ is a function dependent upon the installation length of the support $\alpha$ is the cooperation coefficient of the rock and the support, that is a function of the geometrical dimensions of the cavity and the wall thickness of the concrete support, as well as the material constants of the rock and the support $\phi$ is a function of the geometry of the support dimensions $n_1$, $n_2$ are safety factors In the case of a support of shot concrete of circular section with a radius R and a thickness v the following values apply:

$$A = 1$$

$$\alpha = \frac{E_b(2Rv - v^2)}{E_b m_b^2(2Rv - v^2) + 2G(m_b + 1)[(m_b - 1)R^2 - 2m_b Rv + m_b v^2]}$$

$$\phi = \frac{R^2}{2Rv - v^2}$$

wherein $E_b$ is the elastic modulus of the support

G is the creep elastic modulus of the rock $m_b$ is the Poisson number of the support Determining the wall thickness of shot concrete for a life $t_o$; $v_1$ is determined from the equation:

$$2(\xi P_{pr} - P_o) AL_o [1 - \alpha(1 - e^{\beta t_o})] = \frac{\sigma^{rock}_{permitted}}{n_1}$$

and $v_2$ is determined from the following equations:

$$2(\xi P_{pr} - P_o) AL_o \phi \alpha(1 - e^{-\beta t_o}) = \frac{\sigma^{rock}_{permitted}}{n_2}$$

$\beta$ is a cooperation time factor of the rock and the support, which in the case of a circular section of a radius R and a wall thickness v is:

$$= \frac{E_b m_b^2(2Rv - v^2) + 2G(m_b + 1)[(m_b - 1)R^2 - 2m_b Rv + m_b v^2}{\tau E_b m_b^2(2Rv - V^2) + 2\eta(m_b + 1)[(m_b - 1)R^2 - 2m_b Rv + m_b v^2]}$$

wherein $\tau$ is the relaxation factor of the rock $\eta$ is the creep factor of the rock In order to form the shot concrete wall one requires a machine line which can produce the supporting structure that can optimally adjust itself to local conditions of the structural elements, can solve the transport and the correct proportioning of the materials in accordance with concrete technology. By this machine equipment one can 1/ perform an efficient, entirely homogenized function that activates the mixture 2/ and which concrete, composed by the homogeneization, is brought to the surface in a suitable manner.

The support construction can be built in by itself with clamped-in steel supports, with such supports stabilized with reinforced concrete, and with a reinforced concrete construction. Where a concrete or reinforced concrete structure is combined with the clamped steel supports, account must be taken of the hardening process of the concrete.

As is well known the formation of the rock pressure is also a time-dependent process. The above-described dimensioning process makes it possible optimally to coordinate the two processes and thus to form a structure in the most advantageous way. This decides the material of the construction, the time and manner of the installation.

The installation of the concrete of the construction takes place by way of example with shot concrete technology and fulfils two functions:

a/ the ground concrete layer is continuously applied to the surface of the rock where it causes an excess stress on the gangue material to prevent loosening of the rock while at the same time forming a transitional layer;

b/ a load-bearing concrete shell is formed which is expediently monolithic reinforced conctete and which acts as a load-bearer in the course of the already described mechanical cooperation of the concrete support and the rock.

The contact layer, known per se, serves as a transitional layer which penetrates into the gaps and adapts itself to the load-bearing wall, account being deliberately taken of the material characteristics (rheological characteristics of the rock, its breaking strength, moisture content, etc.).

In comparison with the known principles, the clamping is supplemented by new procedural steps.

For example, the clamping device according to German Pat. No. 1,193,904 is not suitable for the controllable clamping of loads in the vertical and horizontal directions, or to clamp supports of a balanced moment. A cooperation with forepoling is not achieved. The situation is the same with German Pat. No. 1,408,727. Favorable cooperation of the ring and of the rock requires a clamping apparatus which is adjustable to transfer not only circumferential but also radial loads and at a controllable location, so as to achieve favorable contact conditions and/or surfaces.

For this reason, the disclosures of German Pat. Nos. 2,326,686 and 1,283,778 are less effective because they are suitable only to exert tangential loads.

The task is only partially solved by the known clamping devices of the polygonal type (see German Pat. No. 1,193,457 and Hungarian Pat. No. 162,676). The latter teaches that active support can be effective only if it is exerted on a shield surface, thus proving the necessity of an active shield for branch sections in case of drifting with mechanized winning.

The present invention contains a proposal that is equivalent with the above-mentioned but its field of application is different.

A known construction partially solves the above-mentioned disadvantages but its use is limited to specially constructed roof arch supports and is not suitable for exerting large clamping forces.

The forepoling mentioned in the inventive process, and/or one phase of its technology, may in principle be carried out with a number of known forepoling devices but the effectiveness of the work is the greater the better the forepoling, the arch mounting and the clamping phases are coordinated.

The possibility of this cooperation is considerably limited as can be proven with reference to the German Pat. Nos. 2,360,726 and 2,252,450. Another solution, such as that in German Pat. No. 1,080,948, involving a crab, cannot exert adequate forepoling forces and additionally does not enable the joint tensioning of the lining or of the arch. This same disadvantage prevails also with the construction of German Pat. Nos. 2,253,670 and 1,180,704. Other known solutions are limited to solving a given partial task only, e.g. supporting the face (see German Pat. No. 1,193,911) or e.g. the so-called Moll arches.

The aim of the force-introducing mechanism is to change the stress condition of the rock jacket to a supporting element by means of forces of chosen direction and magnitude. In the sense of the invention the essence of the solution is as follows:

1/ The mechanism performs its operations expediently by combination with the working phases of the forepoling device, effected by a displacement of a wire ropeway formed on the forepoling apparatus, connected to a pre-tensioned (i.e. forepoled) upper prop so that the position and stress condition of the latter do not change.

2/ The available space is advantageously exploited. To this end, a hydraulically operable clamping mechanism is used to which temporary supports are connected by way of exchangeable elements—depending on the shape of the cavity. The elements are suitable to take up forces acting in the direction of the sides and the floor. The upper transition is constituted by the projections formed to suit the forepoling device.

3/ A support system for introducing divided forces, which is divided by the spacing elements into an external and an internal support zone. Both supports can be clamped by themselves but not necessarily with the same direction of force introduction and magnitude of force reception.

4/ A mechanism described in 3/ can also be constructed so that the outer support system is filled with concrete, and during the hardening—setting time tension of the internal support arch—provides the supplementary portion of the conserving reaction system and is dismantled once the concrete has hardened.

5/ A force introducing and transmitting mechanism wherein the internal hydraulic clamping mechanism and/or temporary supports connected thereto cintain a securing projection to which a drilling machine—for anchoring the rock—and a feed lafette can be secured for including a rock screw of proper direction.

6/ The performance of force introducing is carried out by partially simultaneous rock anchoring and the latter takes place in the course of the conservation of the clamping.

Clamping mechanism: Connection or support which contacts the cavity section and is capable of introducing the forces.

1/ The arch elements are clamped by radial devices using such forces as will ensure that the support element, e.g. a clamping ring, is deformed to some extent in the cavity. The points of attack of the forces are so determined that the bending stresses in the arch elements are equalized to a certain degree.

2/ The mounting and clamping described in 1/ is combined with tangential stressing of the arches so as to conserve the stressing effects.

3/ The conservation of the introduced stress condition takes place with such a force distribution that the load-bearing of the support element is optimal, the force distribution having a radial and a tangential component.

4/ The mounting of the support apparatus (e.g. a ring) is clamped such that a suitably dimensioned grid is mounted on the adjacent surfaces which grid is intersected by the supporting arches and has transverse elements (for roads, elements directed along the axis of the road) whereby to transmit clamping forces so that the intermediate space is protected from fall and is pre-tensioned by pressure.

5/ The mounting can also be performed for the force conservation so that the used elements remain partly in the concrete but may be partly located outside the concrete. The latter elements can be recovered after the concrete has set. Forepoling follows the sequence of making the cavity (road building, tunnel building, etc.) and loading, or is parallel with the latter in the operational sequence of cavity formation. The task of forepoling is to prevent the covering rock from falling by producing such a stressed condition which is suitable for the disturbance-free performance of the transition to the clamping in of the support element without loosening the rock.

Forepoling can be performed according one of the following operational procedures:

1/ In an operational step the roof support elements and the spatial grid elements are clamped in at the same time in a position that the same is not changed when the final forces are introduced.

2/ Forepoling can also take place by a different method, with paired support beam which are movable by way of a hydraulic mechanism via a lever so that during forepoling the beam is not only tilted from its lower position but also performs a forward motion.

3/ The arrangement needed for this purpose can be built such that the vertical and horizontal bends of the cavity are simultaneously secured:

by an upper (transitional) support wherein the forepoling main support is fitted with the aid of a displaceable guide;

The upper guide of the main support is divded into two parts by a pivot; the rear portion can be adjusted in accordance with the requirements of the curvature of the cavity;

An element (e.g. a chain) is moved through the working cylinder of the arrangement, in its idle phase, which advances the apparatus step by step.

The generation of the stresses and deformed cidition as well as their conservation produced by clamping with radial and tangential forces may also be combined with the per se known rock bolting. The rock bolt is suitable for achieving force conservation by radially acting means. The bedding of the rock bolting performed not only along tangential but also along axial support elements (that is along the axial supports of the grip). Thus the created stress condition may be optimally chosen and maintained both in the plane of the expanding ring and in the intermediate field.

By having due regard to the main directions of the stresses and the magnitudes of the primary stresses, the disposition of the rock bolts can be such that the given cavity configuration assumes an optimal stress condition.

In order to realize the inventive process the machine arrangement requires the following conditions to be fulfilled:

it should fit in well in the complex technological processes of cavity formation;

it should not handicap the performance of the other steps;

it should provide an output as required by the velocity of the face;

it should ensure the multi-stage shaft formation so that in given cases the installation of the required steel section supports (e.g. installation of the steel rings), as well as the subsequent procedural step, is carried out with the same machines, and also the application of the contacting concrete and the load-bearing shaft;

it should be suitable for walling any kind of cavity (road construction, etc.).

The preparation of a monolithic shaft can be divided into two technological main groups:

1/ the composition and homogeneization of the material;

2/ the spreading of the material.

The compiling of the shaft material consists in the selection of solid, particulate or pulverulent materials, liquid binder materials, etc., which are intermixed in predetermined quantities from prepared packages or containers.

Because of the given characteristics of the site—the composition of the material requires—according to the operating possibilities—such arrangements that consist of variable elements which can be put together in a modular manner. An absolute pre-condition is the space requirement and the necessary transport path. A relative condition is constituted by the opening of a road section and the associated technical procedures.

The formation of the wall is effected by a shooting machine. (A known machine can be studied in German Pat. No. 2,000,278.) A shooting head is attached to the end of its hose. The lining of individual sections of the wall cannot always be carried out by the operator while standing on the ground. Movable platforms have proved useful in external use but in underground working sites can only be used on larger sections. In most cases the dimensions of the platforms are such that they cannot be kept in operation together with the machines—which carry out the required technological operations—and cannot therefore be properly used.

An effective solution is realized by a manipulating apparatus with automatic position control, which enables the operator to apply one charge of concrete in one position with a satisfactory quality. The application of shot or sprayed concrete technology requires that the operator should feel the forces exerted on the shooting head and see its movement and the formation of the wall of lining.

It is better if the operator is disposed from the spraying head at a distance of a few meters, in a quiet situation—while being in complete possession of his capacity for intervening directly and for sensing the physical parameters—and should be abel to form a complete, perfect lining in a fixed position, without moving the platform.

The accompanying drawings illustrate an exemplary embodiment of the machine arrangement according to the invention, wherein:

FIG. 2 is a side view of the force applying mechanism;

FIG. 3 is a modified variant of FIG. 2; In the

FIG. 4 is a view taken along the line m—m in FIG. 3; in the

FIG. 11 is a continuation of the device of FIG. 10; in the

FIG. 15 is a side view of the manipulating device; and in the

FIG. 16 is the sensing unit forming part of the manipulator of FIG. 15.

Figure 1:
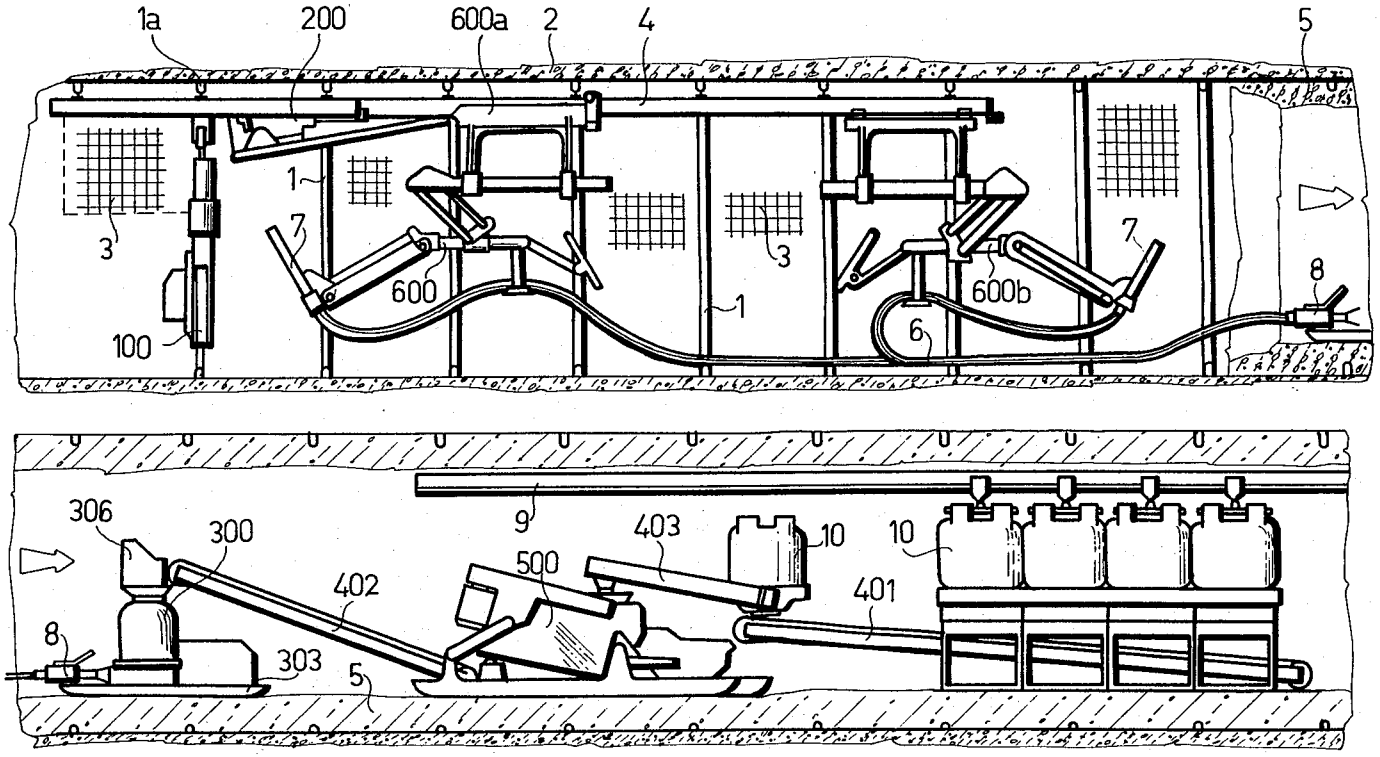
FIG. 1 illustrates the operating features of the arrangement.

Reverting to FIG. 1 one notes that the installation of a support into a mining section commences by inserting a main prop 1*a* of steel arches 1. The main prop is tensioned by a forepoling apparatus 200, applying to the surface of the cavity first a contacting concrete layer 2. This eliminates unevenness so that both the steel arches 1 as well as a grid 3 placed therebetween are properly supported. The steel arch or support being completely mounted in the subsequent working phase, is clamped by a force applying device 100.

Parallel with the advancement of the forepoling device 200 a temporary ropeway is installed; the mechanism 100 and a manipulator 600 can be displaced along this ropeway.

The formation of the lining or wall is accomplished with shot concrete, being illustrated in two stages: the concrete layer 2 is applied or spread by the manipulator 600 that is attached to the forepoling apparatus.

Between the latter and the manipulator 600 there is a connecting element 600*a*. The concrete is shot for a load-bearing lining 5 by the aid of a manipulator 600*b* displaceable along the ropeway 4, the manipulators 600, 600*b* having identical constructions, if desired. Hoses 6 effect the conveying of the concrete mixture to shooting heads 7. The material issues from a concrete shooting machine 300 and is guided through a distributor 8 into one of the manipulators 600.

The concrete mixture is filled from containers 10 (which are movable along a conveying track 9) into a mixer unit 500 either by direct emptying or through the intermediary of a balance 450. Transfer of the material before the mixer unit is performed by way of a conveyer belt 401, and by the intermediary of a further belt 402 between the concrete shooting machine and the mixer unit.

Figures 2, 3, 4:
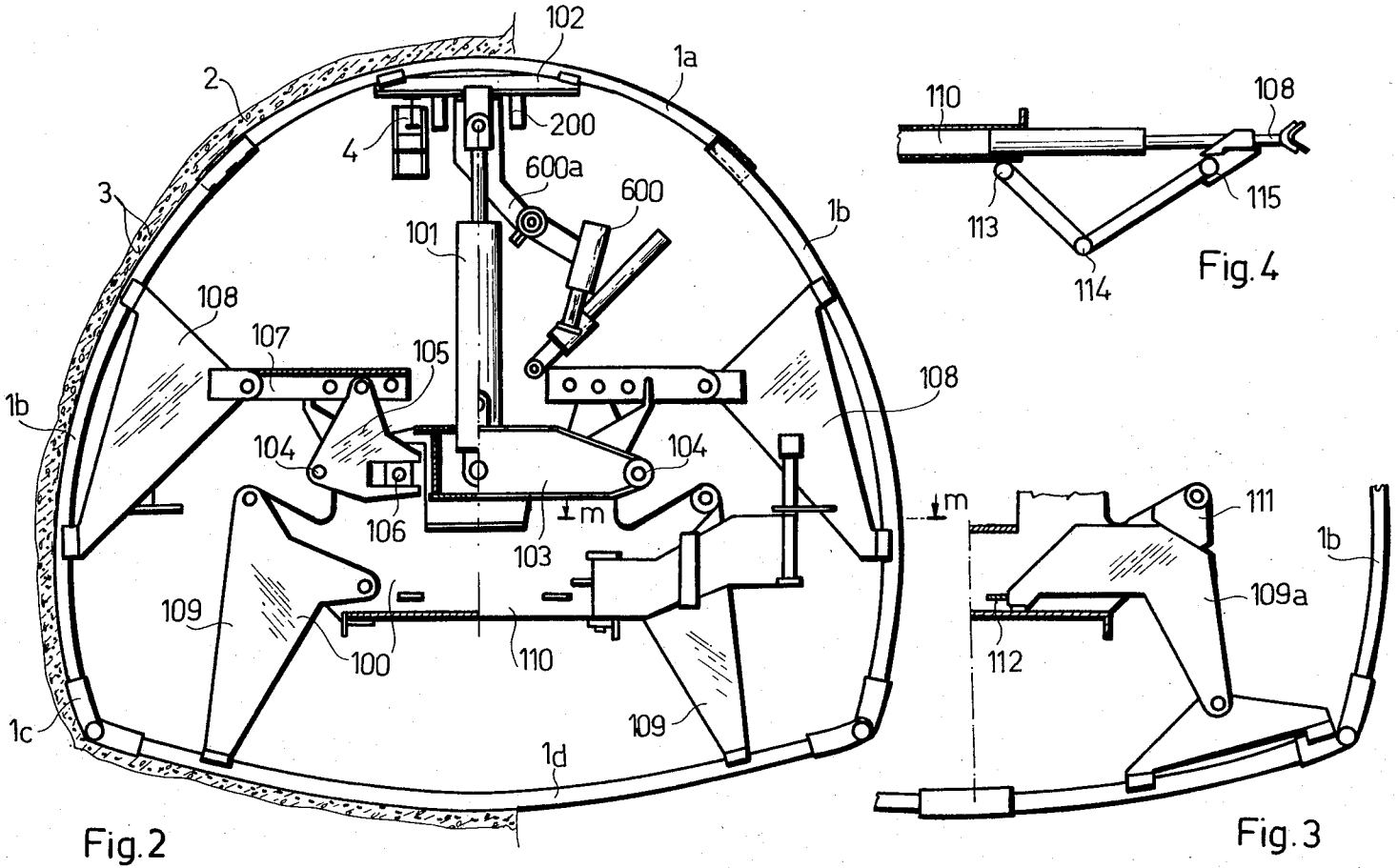

A general constructional form of the force applying mechanism is shown in FIG. 2 for the case of a road section which does not have a circular part. (On the left-hand side of the illustration the arrangement is partly shown in section.)

The arch support 1 includes a roof arch 1*a*, side arches 1*b* and a floor or sole arch 1*d* connected by hinges 1*c*. A force transmitting support 102 is connected to the upper pivot of a hydraulic working cylinder 101. A lower pivot of the cylinder is connected to a transverse beam 103, which latter is connected to a bell-crank lever 105 by way of pivots or hinges 104. The lever 105 has a stationary pivot 105 which is adjustable in relation to the hinge 104. Horizontal forces from the lever 105 are conveyed to a force transmitting support 108 by way of a push rod 107. The horizontally acting forces are transmitted through the levers 105. A base body 110 serves to hold the entire mechanism together. The configuration of the floor or sole arch 1*d* may be completed in various ways and thus a force transmitting support 109 may also have various embodiments. In the exemplary embodiment a support 109 is shown that only transmits vertical loads. According to FIG. 3 a transmitting support 109 can be tensioned by means of a wedge 112 and can endure any loads by way of a support 111.

FIG. 4 illustrates a partial section m—m of the arrangement according to FIG. 2. The support having three pivots 113, 114, 115 is for adjustably holding the support 108. With its aid, the latter can be bent to the base body 110. This allows a favorable position changing condition.

Figure 5:
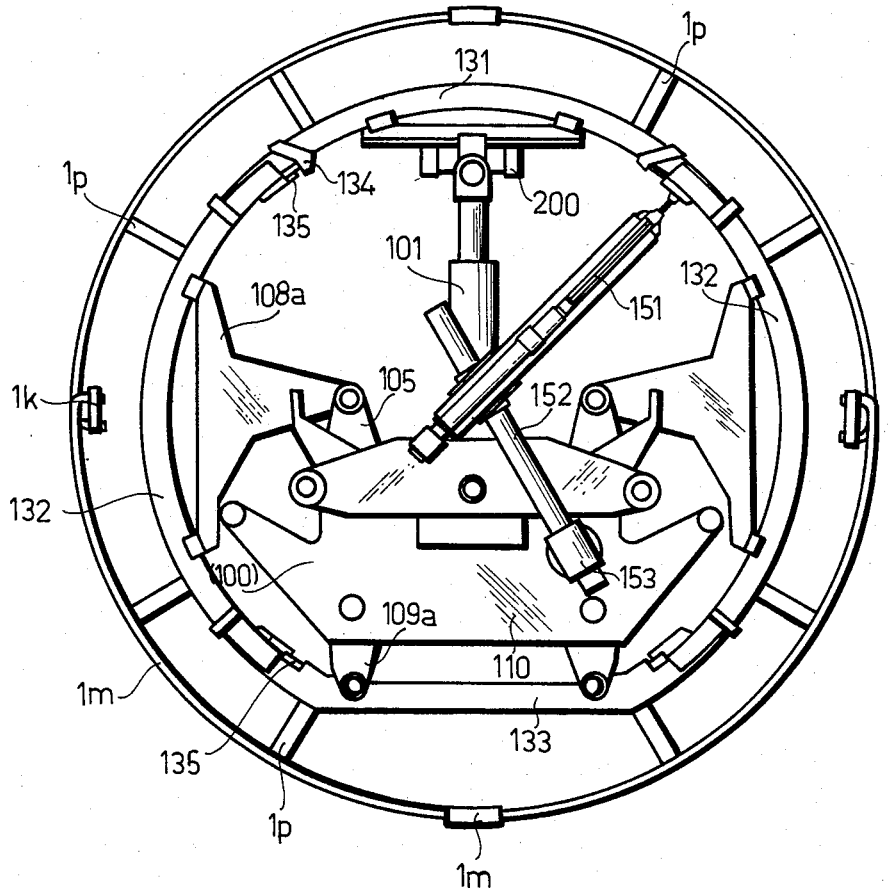
FIG. 5 is a variant of the mechanism shown in FIG. 2, adapted for a circular section; In the FIG. 6 is a view of the conserved state after application of force.

FIG. 5 illustrates the case where force application is performed with a double arch supporting system. The assembled actuating mechanism 100 of the force applying mechanism is again similar to that shown in FIG. 2—however with the difference that the force transmitting supports are adapted to the section of the cavity. The arches 1*m* of the system are fixed to each other by way of fixed connecting elements 1*n* and a clampable connecting element 1*m* (which are effective in a tangential direction).

These parts remain later in the concrete and are connected to the inner support arch by way of force transmitting rods 1*p*, the arch consisting of a roof arch support 131, a side arch support 132 and a lining support 133. Forces transmitted by means of the mechanism 100, by way of force transmitting supports 108*a*, 109*a* and the operating cylinder 101 (known per se), the fixing of the clamped condition being accomplished on the support arch system by clamping a wedge 135. The latter is clamped into a stationary guide disposed on the support arch and/or on a similar guide adjustable on a stirrup 134. On the part that remained in the concrete, a clamping element 1*k* is attached. The latter is a suitably dimensioned flat steel strap bent onto the perpendicularly bent ends according to the illustration. Naturally, conservation may also be carried out with a suitably formed fixing element. It is essential however that the clamped-in condition be maintained when the force applying mechanism is released.

The figure illustrates a roof bolting by way of screws, the holes for the bolts being formed by the aid of a drilling lafette 151 serving this purpose.

Preferably the drilling lafette is mounted on a drilling support, can be set to any desired position, and can be connected to the base body 110 by means of a pivotal connection 153.

Figure 6:
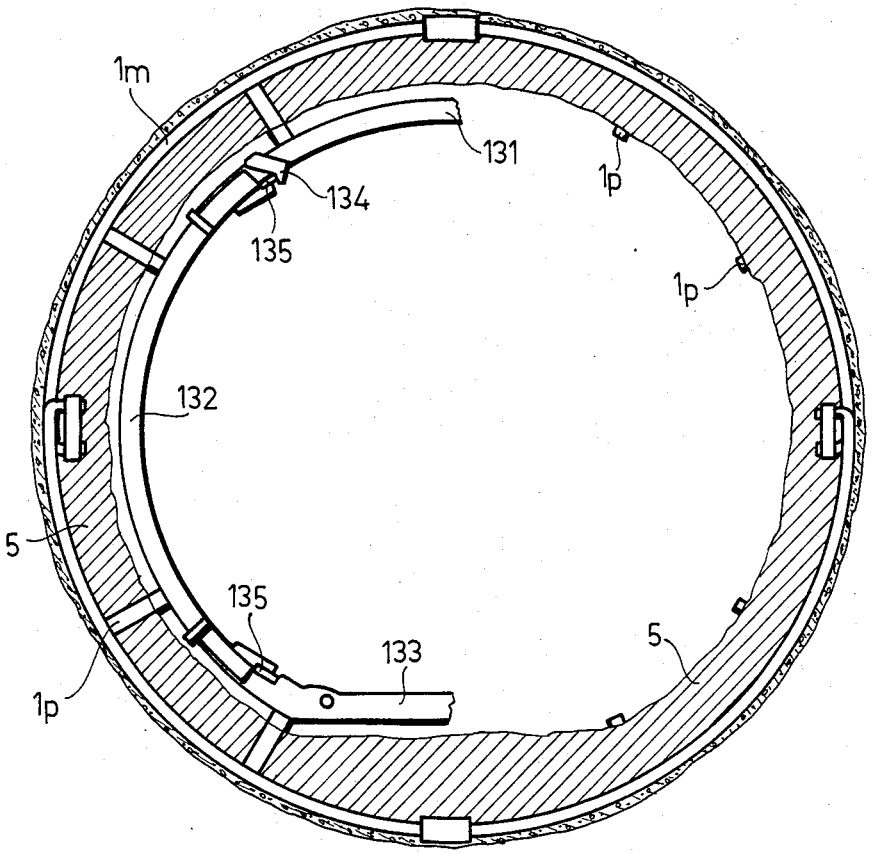

The left-hand side of FIG. 6 illustrates the condition wherein the lining or wall is completed with shot concrete after the arch support has been clamped according to FIG. 5 and the force transmitting mechanism removed. One can see that the length of the transmitting rods 1*p* is to be chosen such that it is somewhat longer by the amount of the wall thickness. On the right-hand side of the figure one can see the completed road section. Here the rods 1*p* are shortened (cut off); it is however possible to utilize the protruding rod ends for suspending purposes.

Figure 7:
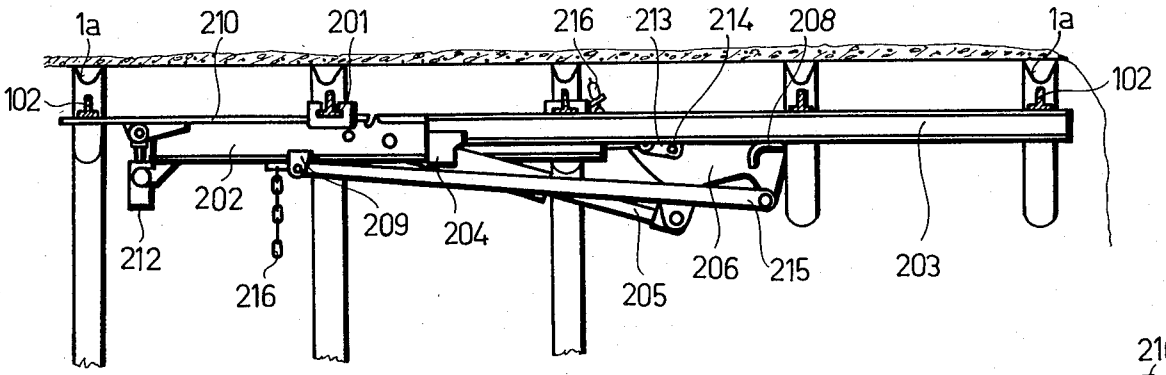
FIG. 7 is a side view of the forepoling mechanism in clamped position; In the FIG. 8 shows a lowered position of the mechanism according to FIG. 7.
Figure 9:
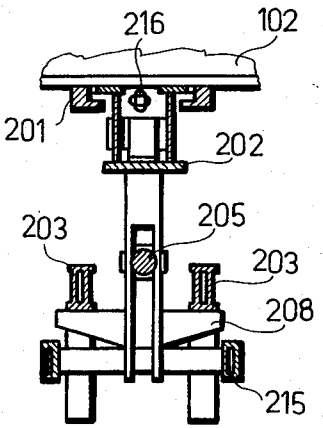
FIG. 9 is a section along the line n—n of the mechanism shown in FIG. 8.
Figure 8:
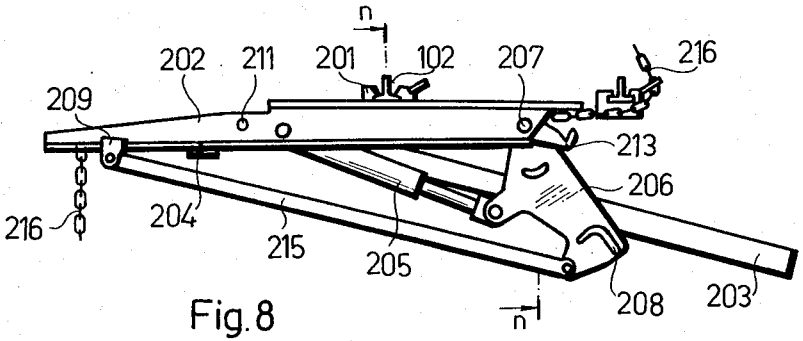

The forepoling apparatus 200 is shown in detail in FIGS. 7, 8, 9. FIG. 7 shows the mechanism in a side view and in its clamped position, FIG. 8 being similarly a side view, in the lowered position, and FIG. 9 constitutes a schematic section of the forepoling apparatus along line n—n.

The intermediate support 102 bears against the roof arch 1*a*. The lower part has an inverted T-profile and has at the bottom a horizontal plane.

At the foot of the T-profile there are displaceable shoes 201 the lower projections of which serve to guide a forepoling body 202. Similarly a pair of forepoling beams rests at the foot, which is pivotally attached at a guide 204. This position allows vertical movement in the space, the horizontal movements being realized at a guide that is formed on the edge of the forepoling body. A bell-crank lever 206 can be rotated about a pivot 207 by means of a working cylinder 205, having an arcuate console 208 that supports the forepoling beams 203.

A horizontal change of direction is made possible by sliding the shoes 201 along the foot of the intermediate support. A change in the vertical plane is possible with the aid of an adjustable sliding shoe 210 of a pivot 211. The required position can be attained by a working cylinder 212.

The forepoling beams 203 are mechanically fixed by a wedge 214 fitted into a guide of a console 213.

The forepoling apparatus is advanced by the aid of the working cylinder 205 such that a rod 215, pivotally connected with the lever 206, pushes a slide 209 "backwards", a chain 216 being on its one end attached to the slide while a supporting ear connects the other end to the shoes 201. Thus the pivot 207 exerts a horizontal advancing force.

Figure 10:
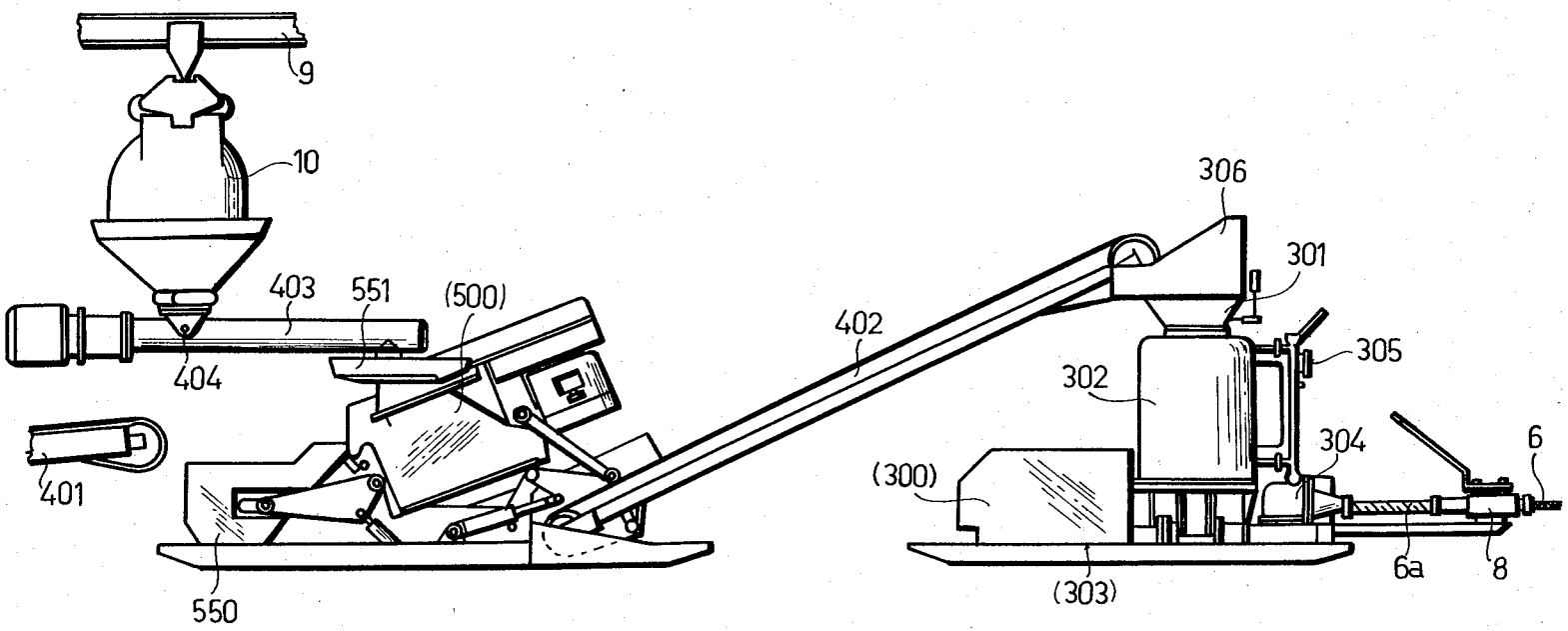
FIG. 10 is a side view of the mixing device.

The shot concrete lining is produced with the spraying machine 300 (see FIG. 10). A shooting head 304—which is rigidly installed on an air tank 302 disposed on a subframe 303—is connected with the distributor 8 by way of a flexible conduit 6*a*. The subframe is so constructed that the individual shooting units are mounted parallel or in a row, interconnected in a known manner. A cooperation of the shooting units is synchronized by means of a control system 305 and as the distributor 8 although a single shooting unit is suitable for applying the concrete lining.

Feed funnels 301 of the apparatus are interconnected by a hopper mechanism 306 whereby the material arriving from the conveyer band 402 is distributed. The output mixture is compiled in the mixer unit 500. For operating the mixer unit, feed vessels 550 and feed horns 551 are provided, the latter being disposed at the mixer unit. Charging of the horns is accomplished simultaneously and automatically according to a predetermined program by the operation of the band 401 and dosing outlets 403.

These outlets may be operated by a known screw mechanism or on the basis of the known fluidization principle. The mixer unit is preferably rotated about a vertical shaft by the aid of a rotating mechanism 404.

Figure 11:
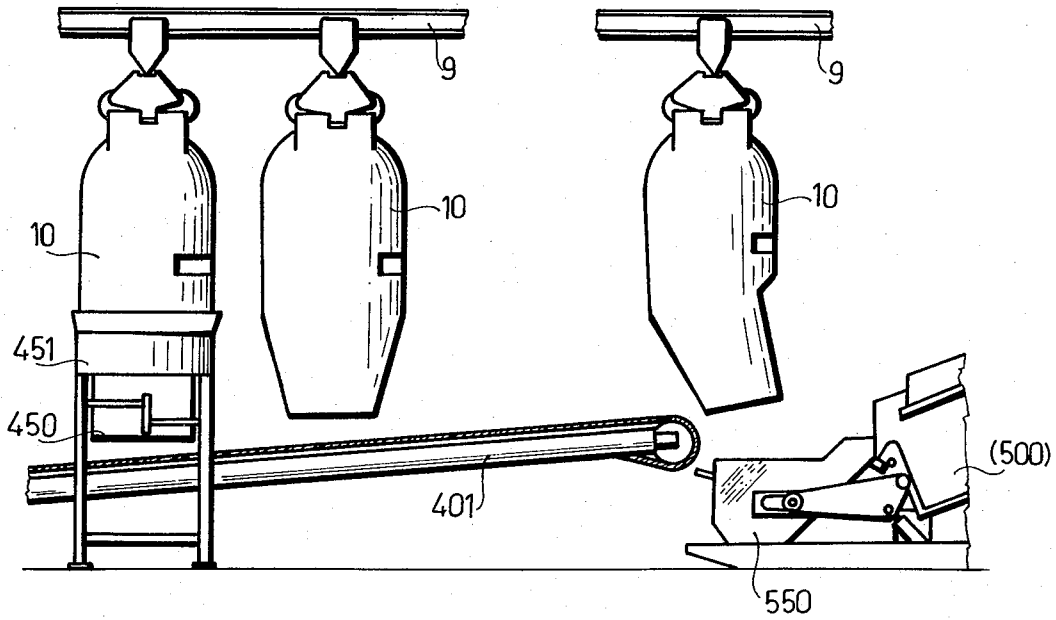

FIG. 11 illustrates three conditions of material supply through the mixer unit.

The material of solid consistency directly charged into one of the vessels 550 from the container 10. This is most advantageous when a particular amount of the material is to be stored in the container 10 (corresponding to a charge). The same applies to the conveyer band 401 so that a container can be directly emptied. It should however be noted that in the latter case a particular amount of material should be interpreted in a broader sense. The container 10 is opened at the bottom and can be placed onto a hopper 451. The material from the container is weighed on the balance 450, and the desired amount is then discharged.

The structural elements from which the balance 450 is assembled can be interconnected with an automatic control system, and they are suitable for compiling the desired amount of material in situ. This allows variable quantities of different wall thicknesses to be produced from the shot concrete, in a pre-programmed manner.

Figure 12:
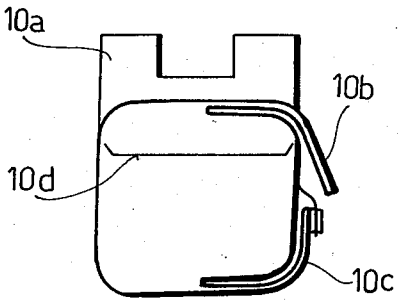
FIG. 12 is a sectional view of the concrete container.

In FIG. 12 a further exemplary embodiment is shown which contains two spaces. The material is filled into the lower space by way of a charging orifice 10*b*, then being covered with a partition plate 10*d*. This allows a different kind of material (for example powders) to be stored above (in the upper space). After a discharge orifice 10*c* is opened, the various materials can be emptied simultaneously. The container 10 may be suspended by way of ears 10*a*. The container can be filled in any position but the discharging should only be performed when it is suspended.

Figure 13:
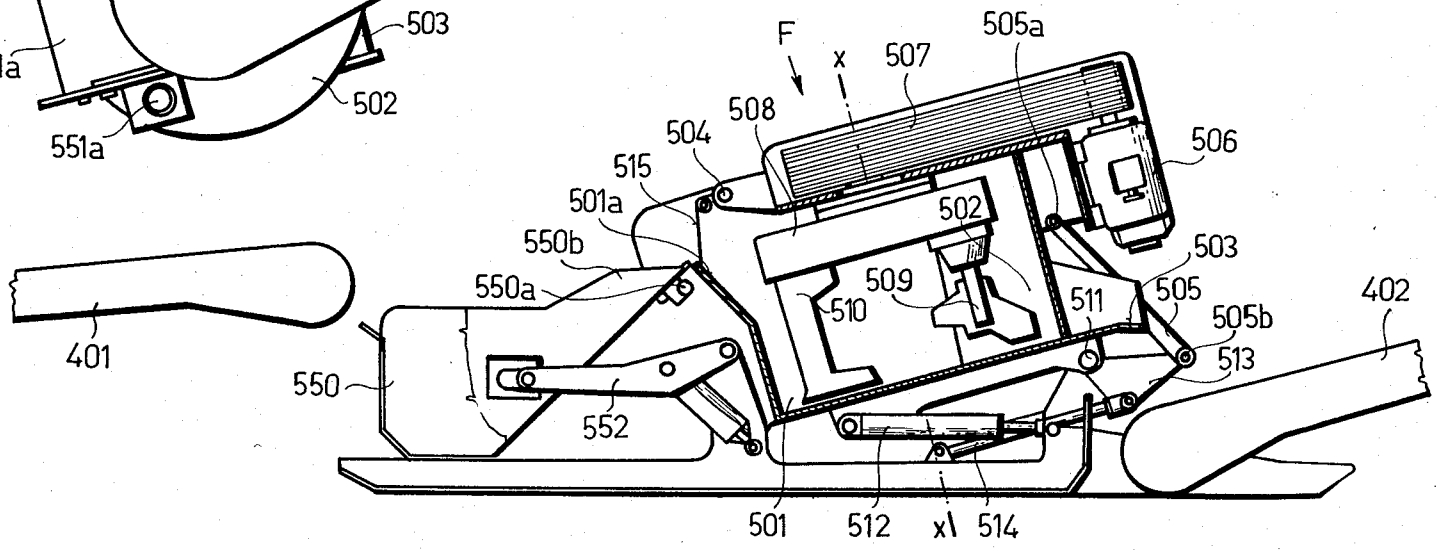
FIG. 13 is a longitudinal section of the mixer unit of the arrangement.
Figure 14:
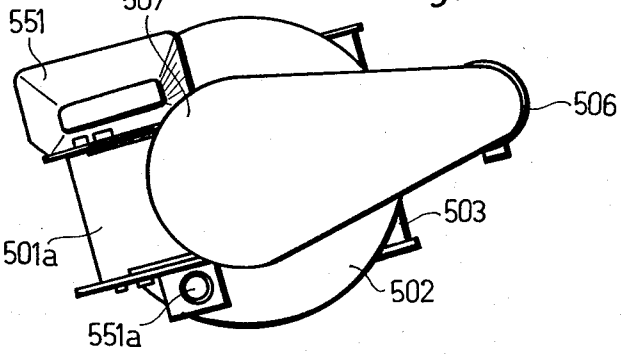
FIG. 14 is a plan view, direction of F, of the mixing device of FIG. 13.

FIG. 13 shows the mixer unit in a longitudinal section while FIG. 14 is an axonometric illustration in the direction of the arrow F. The mixing vessel has two parts: a lower part 501 and an upper part 502, that are coupled together by way of a pivot 504. In the closed position, the vessel is preferably in an inclined position (optimally 15° to 25°), so that a discharge spout 503 should be higher than ground level.

On tilting, the bottom part 501 is pivoted about a pivot 511, and the upper part 502 about the pivot 504—as a result of the position of two pivot points 505*a* and 505*b* of a spacer rod 505—whereby the discharge spout 503 empties the material onto the belt 402.

Both the upper and the bottom parts of the vessel have an inner, cylindrical space, the axis x—x of which is designated in the illustration. The mixer unit is driven by a motor 506 by way of a transmission 507 and a drive 508. Mixing is effected by the aid of a rotated blade system 510 and another blade system 509 that performs a planetary movement. Tilting is accomplished with a working cylinder 512. It happens that the material, mixed with adhesive additioves, cannot be discharged through the spout 503—even with a very steep tilting angle. The pivot 505*b* is provided on a bell-crank lever 513 which can be rotated in the titled position of the vessel by means of a working cylinder 514 and an articulation 515 so that the two parts are locked in the tilted position. This allows the material to be separated by the mentioned blade systems 509, 510, the working cylinder 514 is again actuated so that the drive 508 performs rotary movement. The material is consequently removed.

The filling in of the material is preferably preformed through three apertures, in any desired time distribution. From the feeding vessel 505, the solid, particulate additives may be fed through a lateral hopper 501*a*; the dry, pulverulent additives and/or the hydraulic filling material through the feed horn 551; and the liquids through the pipe 551*a*.

The feed vessel 550 is actuated by a tilting mechanism 552 in that it can be rotated about a pin 550*a* whereupon a discharge spout 550*a* can be placed onto the side hopper 501*a*. Pulverization is inhibited by a closing plate 515. During feed this plate is lifted by the spout 550*b* so that a free cross-section is opened for discharging.

Figures 15, 16:
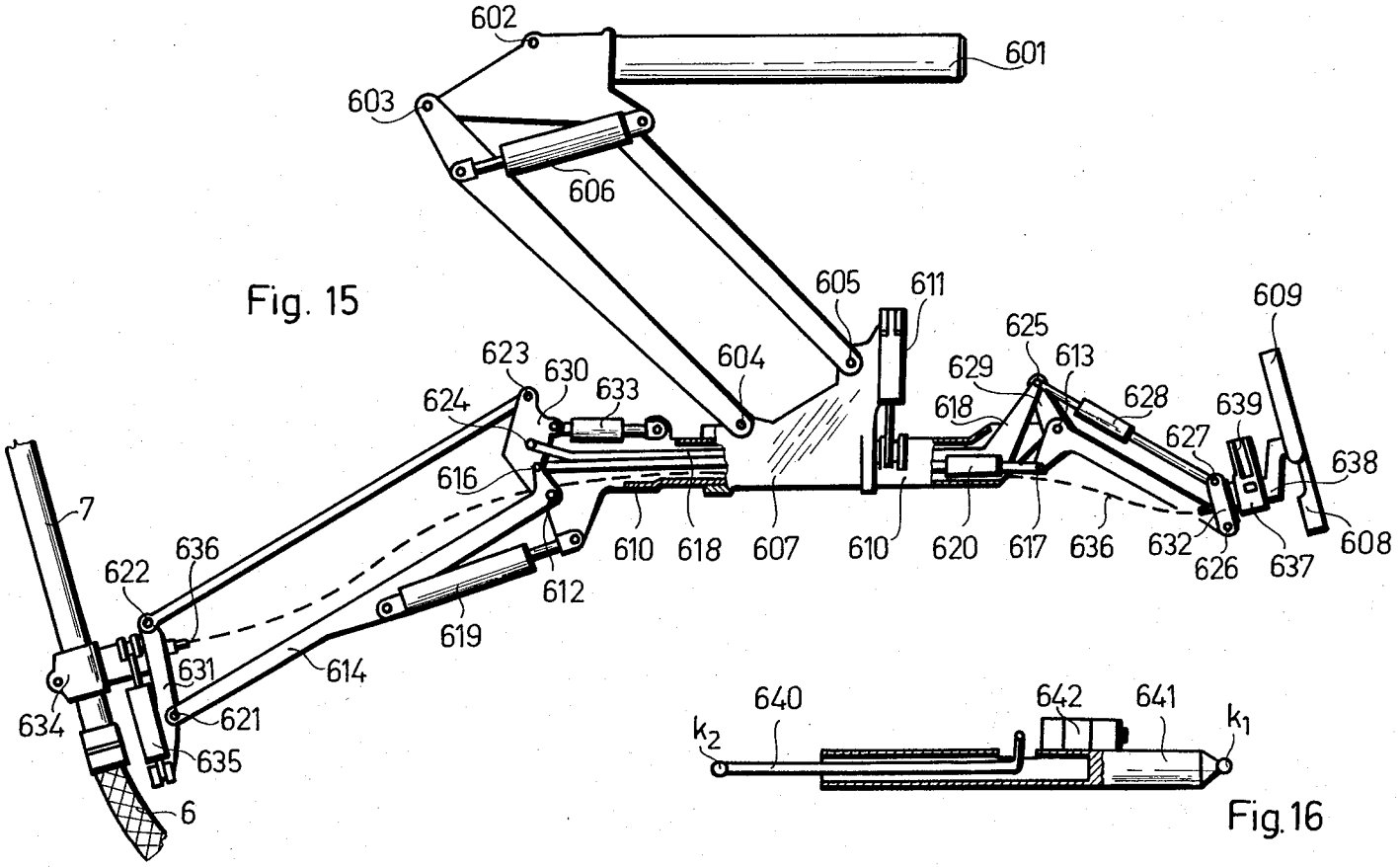

The manipulator 600 is shown in FIG. 15.

A holding tube 601 serves to fix the manipulator 600, and its position is generally parallel with the axis of the road section. Pivots 602 and 603 on the tube as well as further pivots 604 and 605 mounted to the manipulator 600 constitute a parallelogram. When a working cylinder 606 is actuated a body 607 of the manipulator moves parallel to the axis of the holding tube 601. This realizes a movement of the manipulator that is true to the axis. The working cylinder is controlled by an arm 608. A directing arm 609 is held by the operator, its position being always parallel to the shooting heads, its directions of movement being identical, and the displaced distances being proportionally projected in advance.

In a cylindrical bore of the manipulator body 607 is a member 610 that is rotated about a drilling axis parallel to the road section by means of a working cylinder 611, its movement being controlled by shifting the arm 608. Pivots 612, 613 are on the member 610. The former performs the operation while the latter gives a back signal. Between pivots 616, 617—mounted to the arms 614, 615—there is a rod 618 which is chosen so that the relative rotation of the two arms occurs in mirror fashion.

The arm 614 is moved by a working cylinder 619, it is controlled by a valve 620 which is disposed on the rod 618. The control valve 620 is responsive to the force effect of the arm 609. A bell-crank lever 630 is provided on the member 610, rotatable about the pivot 612, and the pivot 613 has a further lever 629 such that the pivots 612, 613, 624, 625 constitute a rod parallelogram. This system performs parallel movements and has associated therewith on the operating side a rod parallelogram consisting of the pivot 612 and of elements 621, 622, 623, and at the operating side another rod parallelogram consisting of the pivot 613 as well as elements 625, 626, 627, for moving a shooting head 631 and an aiming device 632 in a conform manner. The movement is carried out by a working cylinder 633 by way of a control valve 628, in accordance with the force effect of the arm 609. A support of a head casing 634 is rotatably inserted in a bore of the body of the shooting head 631. Rotary motion is accomplished by an operating cylinder 635. Its position is couled to a flexible shaft 636, and to an analogous shaft of the aiming device 632. A control valve 639 attached to a tubular shaft 637 and a member for determining the direction, as well as a support 634, insure conform movements.

The constructional principle of the connecting rods 618 and 628—which serve as pre-sensors—can be seen in FIG. 16.

Coaxial, telescoped half-rods 640, 641 are disposed between pivots $k_1$, $k_2$, and they are interconnected by way of a linkage of a valve 642. The center position of the valve is insured by means of a spring. The linkage can be moved outwardly against the spring force or inwardly, to produce the appropriate valve position.

It is an advantage of the invention that every operational step of supporting or ensuring roads designed for long life are fully mechanized to enable them to be carried out solely by machines. In this way, it achieves a significant reduction in the physical labor carried out under very difficult conditions, as well as a shortening of the required time.

The invention also enables optimization of the utilization as well as of the quantity of the installed support materials because, after determining the parameters of the rock, it utilizes the latest rock-mechanical principles and can compute all road supporting parameters. The invention allows to select the most appropriate support construction and machine arrangement.

What is claimed is:

1. The method of bracing an underground cavity comprising the steps of:

(a) contacting the cavity with a circumferentially continuous and tensionable layer;

(b) inserting an expansible, closed-ring arch into said cavity against said layer;

(c) tensioning said arch to maintain stress both in the plane of the expanding ring and in its intermediate field; and (d) clamping said tensioned arch in position.

2. The method of bracing an underground cavity comprising the steps of:

(a) lining the cavity with a tensionable layer;

(b) inserting a plurality of expansible arches into said cavity against said layer and increasing the distance of separation between arches above the distance of separation used for unstressed arches; and (c) pre-stressing said arches in accordance with their distance of separation and clamping the archines in position.

3. The method of claim 1 wherein said tensionable layer is concrete.

4. The method of claim 1 including the further step of inserting a second expansible, closed-ring arch into said cavity of the first mentioned arch and tensioning said first arch through said second arch.

5. The method of claim 1 including the further step of lining said arch with a second layer.

6. The method of claim 1 wherein said closed-ring arch includes a plurality of members which are hinged together.

7. The method of supporting an underground cavity, comprising the steps of:

(a) lining the cavity with one or more stressable layers;

(b) inserting an expansible arch into said cavity against said layer; and (c) tensioning said arch and clamping it in position; said layers being/of shot concrete and loaded in accordance with the following correlations:

$$2\,(E\,P_{pr} - P_o)AL_o[1 - a(v_1)\,(1 - e^{-bt_o})] = \frac{s^{rock}_{permitted}}{n_1}$$

further $$2\,(E\,P_{pr} - P_o)AL_o\phi\,a(v_2)\,(1 - e^{-bt_o})] = \frac{s^{support}_{permitted}}{n_2}$$

and $$v = \mathrm{Max}(v_1;\, v_2)$$

wherein

E is a factor dependent on the purpose of the cavity $P_{pr}$ is the primary stress prevailing at the location of bracing the cavity $s_{permitted}{}^{support}$ is the standard load permitted for the support $P_o$ is the clamping force A is a mechanical constant which is computed from and depends on the shap and dimensions of the cavity $L_o$ is a factor dependent on the installation spacing a is the cooperation coefficient of the rock and the support $v_1$ is the wall thickness computed on the basis of the load-bearing capacity of the rock e is 2.71 . . . (the base number of natural logarithm)

b is the time factor of the cooperating rock and support $t_o$ is a planned life of the cavity $s_{permitted}{}^{rock}$ is the permitted standard load for the rock $n_1$ is a safety factor $\phi$ is a function of the geometry of the support dimensions $V_2$ is the wall thickness computed on the basis of the load-bearing capacity of the support $n_2$ is a safety factor v is the greater of the two values $v_1$ and $v_2$.

8. The method of bracing an underground cavity comprising the steps of:

(a) lining a cavity with a tensionable layer;

(b) inserting an expansible, closed-ring arch into said cavity against said layer;

(c) tensions said arch to maintain stress both in the plan of the expanding ring and in its intermediate field; and (d) clamping said tensioned arch in position; said tensioning being accomplished by a pressure $P_o$ in accordance with the following formula:

$$P_o = E\,P_{pr} - \frac{s^{support}_{permitted}}{2\,a\,(An\,(1 - e^{bt_o})}$$

where:

$P_o$ is the stressing pressure $P_{pr}$ is the primary stress prevailing at the location of bracing the cavity E is a factor dependant on the purpose of the cavity $s_{permitted}{}^{support}$ is the standard load permitted for the support a is the cooperation coefficient of the rock and the support A is a constant which is computed from and depends on the geometry and dimensions of the support n is a safety factor e is 2.71 . . . (the base number of natural logarithm)

b is the time factor for the cooperating support and rock $t_o$ is the planned life of the cavity.

9. The method of bracing an underground cavity comprising the steps of:

(a) lining the cavity with a tensionable layer;

(b) inserting a plurality of expansible arches into said cavity against said layer and increasing the distance of separation between arches bove the distance of separation used for unstressed arches; and (c) pre-stressing said arches in accordance with their distance of separation and clamping the arches in position;

said cavity containing a plurality of prestressed arches with a spacing $L_o$ in accordance with the following formula:

wherein $$L_o = L \cdot \psi$$

$$\psi = \sqrt{\frac{E \cdot P_{pr}}{E\,P_{pr} - P_o}}$$

and $L_o$ is the extended spacing of the supports at a stressing pressure $P_o$

L is the installation spacing of supports without prestressing

E is a factor dependent on the purpose of the cavity $P_{pr}$ is the primary stress prevailing at the location of bracing the cavity $P_o$ is the stressing pressure.

10. The method of supporting a cavity which comprises the steps of:

(a) contacting the walls of the cavity with a tensionable shell;

(b) inserting an expansible ring in said cavity against said shell; and (c) tensioning said shell through said ring by forces which are entirely radial to said expansible ring.

11. The method of claim 10 wherein said ring is tensioned through an auxiliary ring within the ring against said shell.

12. The method of claim 11 wherein pressure to tension said ring is transmitted from said auxiliary ring by transmission through rods which connect the ring against said shell with said auxiliary ring.

13. The method of claim 12 wherein said auxiliary ring is removed by cutting it from said rods which support a further shell applied to said tensionable shell.

* * * * *